United States Patent [19]

Zepko

[11] 4,357,094

[45] Nov. 2, 1982

[54] MOLDED SCRAPER FOR ELECTROPHOTOCOPIER FIXING ROLLER

[75] Inventor: Richard F. Zepko, Oxford, Conn.

[73] Assignee: Pitney Bowes Inc., Stamford, Conn.

[21] Appl. No.: 218,898

[22] Filed: Dec. 22, 1980

[51] Int. Cl.[3] ..... G03G 15/20

[52] U.S. Cl. ..... 355/3 FU; 355/15; 15/256.51

[58] Field of Search ..... 355/3 FU, 15; 15/1.5 R, 15/256.5, 256.51; 100/174

[56] References Cited

U.S. PATENT DOCUMENTS

| | | | |
|---|---|---|---|
| 1,945,761 | 2/1934 | Vickery | 15/256.51 |
| 3,610,203 | 10/1971 | Müller | 15/256.51 X |
| 3,986,227 | 10/1976 | Fathergill et al. | 355/15 X |
| 3,986,453 | 10/1976 | Bööse | 15/256.51 X |
| 4,165,965 | 8/1979 | Bernardelli et al. | 335/3 FU X |

FOREIGN PATENT DOCUMENTS

| | | | |
|---|---|---|---|
| 54-127333 | 10/1979 | Japan | 355/3 FU |
| 55-38554 | 3/1980 | Japan | 355/15 |

*Primary Examiner*—G. Z. Rubinson
*Assistant Examiner*—Keith E. George
*Attorney, Agent, or Firm*—Lawrence E. Sklar; William D. Soltow; Albert W. Scribner

[57] ABSTRACT

The combination of a pressure fixing roller for an electrophotocopying machine and a scraping device operatively associated with the roller for removing toner material accumulated on the roller. The scraping device includes an angled blade having a scraping portion and a supporting portion oriented at an acute angle with respect to the scraping portion, and a plastic bracket surrounding the supporting portion of the angled blade and having a first, angled, reinforcing member extending along most of the downstream side of the scraping portion of the angled blade relative to the rotation of the roller and a second, smaller, angled, stiffening member extending along a small portion of the upstream surface of the scraping portion of the angled blade and terminating in a direction substantially parallel to the scraping portion of the angled blade.

5 Claims, 2 Drawing Figures

MOLDED SCRAPER FOR ELECTROPHOTOCOPIER FIXING ROLLER

BACKGROUND OF THE INVENTION

The instant invention relates to electrophotocopying machines, and more particularly to a molded scraper blade unit used for cleaning the pressure fixing rollers of an electrophotocopying machine.

In pressure fixture photocopiers, the developed image is fixed to the copy sheet paper by feeding the copy sheet bearing the unfixed toner between a pair of heated or unheated pressure fixing rollers which cooperate to force the toner particles into the copy sheet. In the course of the fixing process, some of the toner particles adhere to the fixing rollers, which if not removed immediately, may appear on other portions of the copy sheet being processed or on subsequent sheets. It is therefore a common practice to provide a device to remove the excess toner accumulated on the rollers, one such device being a scraper blade. However, conventional scraper blades tend to generate noise (chatter), and, owing to insufficient rigidity, to twist. Accordingly, the instant invention provides a scraping device for the fixing rollers in an electrophotocopying machine which reduces scraper noise, increases scraper rigidity and decreases twisting of the scraper blade.

SUMMARY OF THE INVENTION

The instant invention provides, in combination, a pressure fixing roller for an electrophotocopying machine and a scraping device operatively associated with said roller for removing toner material accumulated on said roller, said scraping device comprising an angled blade having a scraping portion and a supporting portion oriented at an angle with respect to said scraping portion, and a plastic bracket surrounding the supporting portion of the angled blade and extending along most of the underside of the scraping portion of said angled blade.

DETAILED DESCRIPTION

Figure 1:
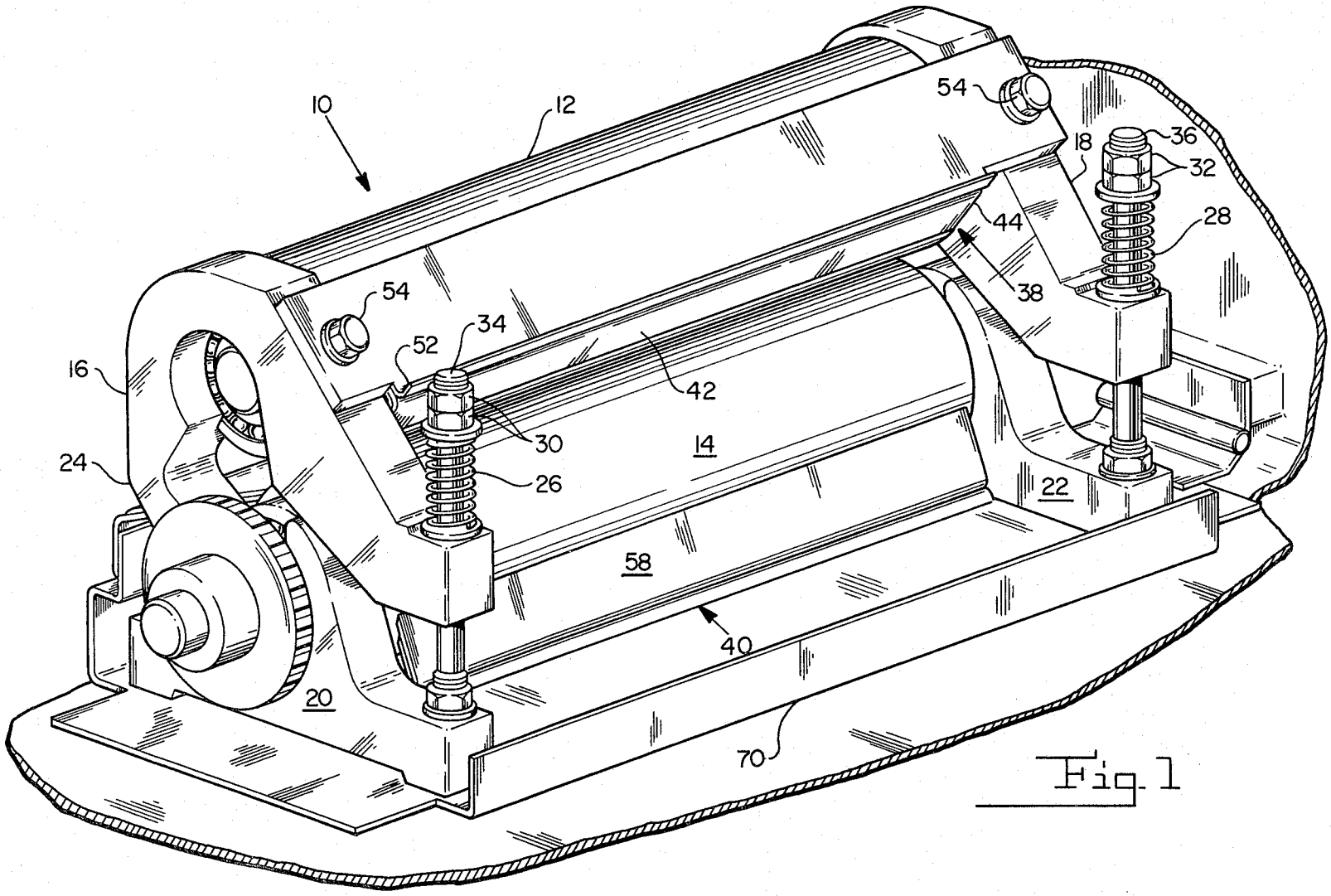
FIG. 1 is a perspective view of a pressure fixing roller assembly for a photocopier embodying the instant invention.
Figure 2:
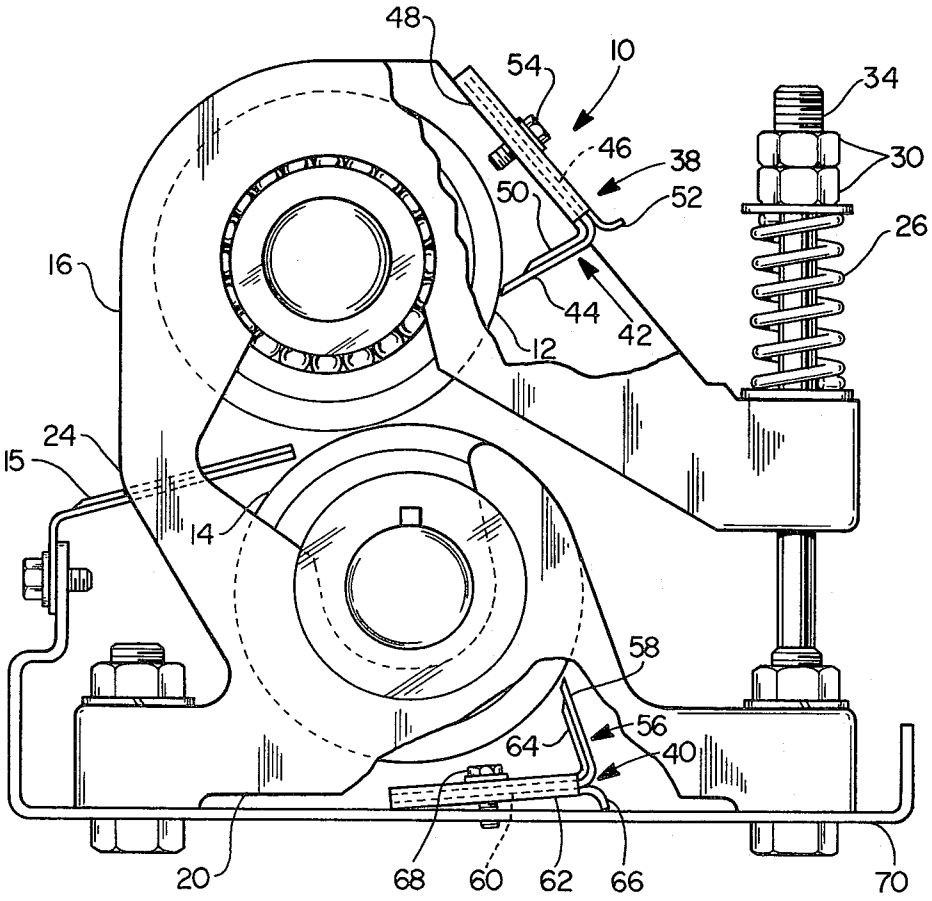
FIG. 2 is an enlarged, side elevational view of the pressure fixing roller assembly shown in FIG. 1.

In describing the preferred embodiment of the instant invention, reference is made to the drawings, wherein there is seen a pressure fixing roller assembly generally designated 10 suitable for fixing toner to a copy sheet without the use of heat in an electrophotocopying machine (not shown). It should be noted, however, that the invention is equally applicable to a pressure fixing roller assembly which does employ heat. The roller assembly 10 includes a pair of pressure fixing rollers 12 and 14 which are parallel to each other. Copy paper (not shown) is fed from a paper guide 15 through the rollers 12 and 14. The rollers 12 and 14 are cylinders made of hardened steel rotatably supported, respectively, by a pair of upper arms 16 and 18 and a pair of lower arms 20 and 22. Each pair of upper and lower arms, i.e. upper arm 16 and lower arm 20 being a pair, and upper arm 18 and lower arm 22 being a pair, is formed as an integral unit which tapers to a narrow cross section at the juncture 24 of the upper and lower arms. Each of the junctures 24 functions as a common pivot for its respective upper and lower arm.

Pressure is applied to the rollers 12 and 14 through the springs 26 and 28. Each of the springs 26 and 28 is mounted on a bolt 34 and 36 respectively each of which passes through its respective upper and lower arm. The pressure is adjusted by rotating sets of nuts 30 and 32 on the shafts 34 and 36 respectively. It can thus be appreciated that the lower roller 14 is fixed while the top roller 12 is slightly movable with respect to the lower roller 14. The rollers 12 and 14 are driven by means of a drive chain and motor (not shown).

In order to remove toner particles which accumulate on each of the rollers 12 and 14, there are provided scraping devices 38 and 40 for the upper and lower rollers 12 and 14 respectively.

The upper scraping device 38 includes an angled blade 42 extending across the full length of the upper roller 12 and having a scraping portion 44 and a supporting portion 46 oriented at an acute angle with respect to the scraping portion 44. The scraping device 38 also includes a plastic bracket 48 surrounding the supporting portion 46 of the angled blade 42. The plastic bracket 48 includes a first, angled, reinforcing extension 50 which extends along most of the underside of the scraping portion 44 of the angled blade 42 and a second, smaller, angled, stiffening extension 52 extending along a small portion of the outer surface of the scraping portion 44 of the angled blade 42 in a direction substantially opposite that of the first angled extension 50. The entire upper scraping device 38 is secured by screws 54 to the upper arms 16 and 18.

The lower scraping device 40 also includes an angled blade 56 extending across the full length of the lower roller 14 and having a scraping portion 58 and a supporting portion 60 oriented at an acute angle with respect to the scraping portion 58. The scraping device 40 also includes a plastic bracket 62 surrounding the supporting portion 60 of the angled blade 56. The plastic bracket 62 includes a first, angled, reinforcing extension 64 which extends along most of the underside of the scraping portion 58 of the angled blade 56 and a second, smaller, angled, stiffening extension 66 extending along a small portion of the outer surface of the scraping portion 58 of the angled blade 56 in a direction substantially opposite that of the first angled extension 64. The entire lower scraping device 40 is secured by screws 68 to the base plate 70.

The thickness of the blades 42 and 56 is preferably about 0.01 inch, and other means of securing the two scraping devices 38 and 40 to the arms 16, 18, 20 and 22 may be used. The blades 42 and 56 may be formed from carbon steel or stainless steel or non-ferrous material either in the cold worked or heat treated condition or from non-metallic materials having a certain amount of spring characteristics. The plastic brackets 48 and 62 may be secured to the blades 42 and 56 respectively by a variety of techniques, including molding and ultrasonic welding. The angled extensions 52 and 66 function as stiffening members, and may therefore assume shapes other than that depicted in the drawings.

While a particular embodiment of the invention has been shown and described, it should be understood that the invention is not limited thereto since many modifications may be made. It is therefore contemplated to cover by the present application any and all such modifications as fall within the true spirit and scope of the appended claims.

What is claimed is:

1. In combination, a pressure fixing roller for an electrophotocopying machine and a scraping device operatively associated with said roller for removing toner material accumulated on said roller, said scraping device comprising an angled blade having a scraping portion and a supporting portion oriented at an acute angle with respect to said scraping portion, and a plastic bracket surrounding the supporting portion of the angled blade and having a first, angled, reinforcing member extending along most of the downstream side of the scraping portion of said angled blade relative to the rotation of the roller and a second, smaller, angled, stiffening member extending along a small portion of the upstream surface of the scraping portion of the angled blade and terminating in a direction substantially parallel to the scraping portion of the angled blade.

2. The combination of claim 1, wherein the blade is formed from carbon steel or stainless steel.

3. The combination of claim 1, wherein the thickness of the blade is about 0.01 inch.

4. The combination of claim 1, wherein the plastic bracket is molded to the angled blade.

5. The combination of claim 1, wherein the plastic bracket is ultra-sonically welded to the angled blade.

* * * * *